US011591548B2

(12) United States Patent
Munoz Carrillo et al.

(10) Patent No.: US 11,591,548 B2
(45) Date of Patent: Feb. 28, 2023

(54) CLEANING COMPOSITION TO PROVIDE LONG-LASTING WATER REPELLENCY ON SURFACES

(71) Applicant: Colgate-Palmolive Company, New York, NY (US)

(72) Inventors: Carlos Munoz Carrillo, Estado de Mexico (MX); Hiram Delgadillo Verdeja, Mexico City (MX); Cesar Rodriguez Cedillo, Naucalpan de Juarez (MX)

(73) Assignee: Colgate-Palmolive Company, New York, NY (US)

( * ) Notice: Subject to any disclaimer, the term of this patent is extended or adjusted under 35 U.S.C. 154(b) by 256 days.

(21) Appl. No.: 16/955,835

(22) PCT Filed: Dec. 19, 2017

(86) PCT No.: PCT/US2017/067161
§ 371 (c)(1),
(2) Date: Jun. 19, 2020

(87) PCT Pub. No.: WO2019/125399
PCT Pub. Date: Jun. 27, 2019

(65) Prior Publication Data

US 2021/0095230 A1 Apr. 1, 2021

(51) Int. Cl.

| | |
|---|---|
| ***C11D 9/36*** | (2006.01) |
| ***C11D 3/37*** | (2006.01) |
| ***C11D 1/90*** | (2006.01) |
| ***C11D 3/20*** | (2006.01) |
| ***C11D 3/43*** | (2006.01) |
| ***C11D 11/00*** | (2006.01) |

(52) U.S. Cl.
CPC ..... *C11D 3/3738* (2013.01); *C11D 1/90* (2013.01); *C11D 3/2086* (2013.01); *C11D 3/43* (2013.01); *C11D 11/0023* (2013.01)

(58) Field of Classification Search
CPC ..... C11D 1/90; C11D 1/82; C11D 3/042; C11D 3/162; C11D 3/2068; C11D 3/3738; C11D 7/263; C11D 9/36; C11D 11/0023
See application file for complete search history.

(56) References Cited

U.S. PATENT DOCUMENTS

| | | | | |
|---|---|---|---|---|
| 6,239,098 | B1 | 5/2001 | Matsumura et al. | |
| 7,998,918 | B2 * | 8/2011 | Rong | C11D 1/29 510/228 |
| 8,987,184 | B2 | 3/2015 | Davister et al. | |
| 9,670,304 | B2 | 6/2017 | Wang et al. | |
| 2002/0045010 | A1 | 4/2002 | Rohrbaugh et al. | |
| 2006/0281662 | A1 * | 12/2006 | Cheung | C11D 1/835 510/504 |
| 2008/0221009 | A1 | 9/2008 | Kanagasabapathy et al. | |
| 2012/0156377 | A1 * | 6/2012 | Veith | C11D 3/3738 134/28 |
| 2016/0200953 | A1 | 7/2016 | Constantinou et al. | |
| 2018/0064620 | A1 * | 3/2018 | Viravau | A61K 8/87 |
| 2021/0137808 | A1 * | 5/2021 | Mathonneau | A61Q 5/02 |

FOREIGN PATENT DOCUMENTS

| | | | |
|---|---|---|---|
| EP | 2039747 | * | 3/2009 |
| WO | 2001/000760 | | 1/2001 |
| WO | 2014/172535 | | 10/2014 |
| WO | 2015/161233 | | 10/2015 |

OTHER PUBLICATIONS

International Search Report and Written Opinion of the International Searching Authority in International Application No. PCT/US2017/067161, dated Aug. 22, 2018.

* cited by examiner

*Primary Examiner* — Charles I Boyer

(57) ABSTRACT

A cleaning composition comprising: a hydrophobic polymer comprising an organoalkoxysilane; a hydrophilic polymer present in the cleaning composition in an amount ranging from 0.1% to 0.5% by weight based on the total weight of the cleaning composition; a surfactant system; and an acid. A method for cleaning a surface comprising applying the cleaning composition to the surface and retaining the cleaning composition on the surface until it dries.

20 Claims, No Drawings

CLEANING COMPOSITION TO PROVIDE LONG-LASTING WATER REPELLENCY ON SURFACES

BACKGROUND

Cleaning compositions for use on hard surfaces are known in the art. Hard surfaces may include household and outdoor surfaces such as those typically found in bathrooms and kitchens, as well as automobiles surfaces, such as windows and windshields. After cleaning, it is desired to increase the surface's ability to repel water, i.e., increase the surface's water-repellency, as well as to enhance the surface's shine, cleanliness, and ability to protect against material build-up.

It would be desirable to design a cleaning composition that reduces visible residue and increases shine. Acidic cleaners are known that purport to provide activity against mineral deposits, such as lime scale or soap scum, and also for rust removal. Some cleaners are marketed as being useful for cleaning glass surfaces in that they may reduce streaking or the build-up of dirt and dust, and they may provide anti-fog and/or anti-rain benefits (e.g., water-repellency). It is desirable that the beneficial effects of the cleaning composition be long-lasting, so that the consumer does not have to repeat the cleaning process frequently. It is also desirable that a cleaning composition is functional under harsh conditions, such as with exposure to acid rain, heat, cold, and dust.

Prior known cleaning compositions sometimes contained phosphate salts. In view of the environmentalist's efforts to reduce phosphate levels in ground water, improved all-purpose liquid cleaners containing reduced concentrations of inorganic phosphate builder salts or non-phosphate builder salts have appeared. However, these prior art liquid cleaning compositions containing detergent builder salts or other equivalents tend to leave films, spots or streaks on cleaned unrinsed surfaces, particularly shiny surfaces. Thus, such liquid cleaning compositions require thorough rinsing of the cleaned surfaces which is a time-consuming chore for the user.

Therefore, the need exists for a cleaning composition that provides water-repellency to a surface and is effective to remove soil while leaving the surface shiny, as well as prevent the formation of soil spots, lime scale, and buildup over an extended period of time.

BRIEF SUMMARY

Disclosed herein are cleaning compositions comprising a hydrophobic polymer comprising an organoalkoxysilane; a hydrophilic polymer present in the cleaning composition in an amount ranging from about 0.1% to about 0.5% by weight based on the total weight of the cleaning composition; a surfactant system; and an acid. In certain embodiments, the surfactant system comprises a zwitterionic surfactant, and in certain embodiments, the surfactant system comprises cocoamidopropyl betaine. According to certain embodiments, the acid is an organic acid selected from lactic acid, formic acid, citric acid, sorbic acid, acetic acid, glycolic acid, propanoic acid, propionic acid, oxalic acid, maleic acid, tartaric acid, adipic acid, malic acid, malonic acid, glycolic acid, and a combination of two or more thereof, and in certain embodiments, the organic acid is lactic acid. In certain embodiments, the hydrophobic polymer is water-dispersible.

According to various embodiments disclosed herein, the organoalkoxysilane may have the formula $Y—R^1—Si(OR)_3$, wherein Y is an organic reactive group chosen from epoxide, methacrylate, —SH, amine, isocyanate, and vinyl; $R^1$ is an organic non-reactive group; and R is a hydrolysable group. According to certain embodiments, the hydrophilic polymer comprises alcohol ethoxylate and a polyakylene-oxide silane, and in certain embodiments the hydrophilic polymer is an organomodified copolymer, such as Silwet® HS-212 from Momentive Progressive Materials, and in certain embodiments, the hydrophilic polymer is present in the cleaning composition in an amount of about 0.2% or in an amount of about 0.5%, by weight based on the total weight of the composition.

In certain embodiments disclosed herein, the hydrophobic polymer is present in the cleaning composition in an amount ranging from about 0.25% to about 0.75% by weight based on the total weight of the cleaning composition, and in certain embodiments, the hydrophobic polymer is present in the cleaning composition in an amount of about 0.5%, by weight based on the total weight of the cleaning composition.

In certain embodiments disclosed herein, the surfactant system is present in the cleaning composition in an amount ranging from about 1% to about 3%, by weight based on the total weight of the cleaning composition, and in certain embodiments, the organic acid is present in the cleaning composition in an amount ranging from about 1% to about 3%, by weight based on the total weight of the cleaning composition.

According to certain embodiments, the cleaning compositions disclosed herein may further comprise a solvent. According to certain embodiments, the solvent is propylene glycol n-butyl ether and ethyl alcohol, and in certain embodiments, the solvent is present in the cleaning composition in an amount ranging from about 1% to about 6%, such as from about 1 about 3%, about 1.5%, or about 3%, by weight based on the total weight of the cleaning composition.

In various embodiments disclosed herein, the cleaning compositions may further comprise an additional ingredient selected from a colorant, a fragrance, a pro-fragrance, a preservative, a rheology modifier, a structuring agent, a hydrotrope, a whitening agent, a reducing agent, an enzyme, an enzyme stabilizing agent, a builder, a bleach, a photobleach, a bleach catalyst, a soil release agent, a dye transfer inhibitor, a buffer, a soil repellent, a water-resistance agent, a suspending agent, an aesthetic agent, and a combination of two or more thereof.

Further disclosed herein are methods of cleaning a surface, comprising applying a cleaning composition comprising a polymer system comprising a hydrophobic polymer comprising an organoalkoxysilane; a hydrophilic polymer present in the cleaning composition in an amount ranging from about 0.1% to about 0.5% by weight based on the total weight of the cleaning composition; a surfactant system; and an acid; and retaining the cleaning composition on the surface until it dries. In certain embodiments, in the methods disclosed herein, the surface is glass, and in certain exemplary embodiments, the water-repellency of the surface is enhanced after allowing the cleaning composition to dry.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

As used herein, the term "one or more of" with respect to a listing of items such as, for example, A and B, means A alone, B alone, or A and B. The term "at least one of" is used to mean one or more of the listed items can be selected.

Unless otherwise specified, all percentages and amounts expressed herein and elsewhere in the specification should be understood to refer to percentages by weight. The amounts given are based on the active weight of the material.

Disclosed herein are compositions for the cleaning and protection of hard surfaces, such as non-porous hard surfaces including glass. As used herein, surfaces may include a variety of different materials, such as glass, enamel, ceramic, porcelain, stone, stainless steel, resin, and the like. Such surfaces include fixtures such as windows and window panes, windshields, countertops, appliances (e.g., refrigerators, stoves), as well as bathtubs, sinks, and toilets. Surfaces also includes furniture and automobiles. In certain embodiments, the compositions disclosed herein may treat surfaces that are exposed to harsh environmental conditions, such as acid rain, temperature changes, dirt, and dust. The cleaning compositions disclosed herein can be used to clean surfaces by applying the cleaning composition to the surface and allowing the cleaning composition to dry, with or without optionally wiping and/or rinsing the surface after the cleaning composition has been applied. In certain embodiments, the cleaning composition is formulated to be a glass cleaner, such as for the cleaning of windows and windshields. In other nonlimiting embodiments, the cleaning composition is formulated for the cleaning of toilet bowls, shower doors, floors, kitchen surfaces, bathroom surfaces, sinks, and/or appliances.

The cleaning compositions disclosed herein comprise a polymer system comprising a hydrophobic polymer system comprising an organoalkoxysilane, such as Momentive® Y-17713 and Momentive® Y-21089; and a hydrophilic polymer such as Silwet® HS-212. In certain embodiments, the cleaning composition may further comprise a surfactant system; an acid, such as lactic acid; and water.

The cleaning compositions may give a water-repellent effect to the surface to which the cleaning compositions have been applied. This water-repellent effect may be long-lasting, such as lasting at least one day, at least two days, at least three day days, at least one week, and at least one month. In other embodiments, the cleaning compositions may provide enhanced shine or resistance to the formation of soil, lime scale, soap scum or other residue buildup. In other embodiments, the cleaning compositions may remove soil, lime scale, soap scum or other residue buildup off of the surface to which it is applied. Furthermore, in certain exemplary embodiments, the cleaning compositions disclosed herein may permit the fast removal of water, for example on rainy days and during the rinsing process. A user may thus benefit from a protective film formed from applying the cleaning compositions disclosed herein that prevents the formation of soil and dirt spots, such as lime scale, leaving surfaces shiny due to the dirt or stain removal, and is long-lasting, avoiding the need for frequent reapplication of the cleaning composition.

Although not wishing to be bound by theory, it is believed that when the cleaning composition disclosed herein, which is an emulsion formulation, is placed on a solid surface and dried, the composition chemically reacts to the solid surface upon which it has been applied during the drying process via the organoalkoxysilanes in the composition. In certain embodiments, the hydrophobic polymer molecules also react with each other during this drying process, producing a thin, hydrophobic film on the surface of the substrate, such as the glass surface. The film is hydrophobic due to the presence of the alkyl groups in the polymers. Due to the chemical nature of the adhesion between the solid surface and the hydrophobic film, the hydrophobicity may, in certain embodiments, be long-lasting, such as lasting at least one day, at least two days, at least three day days, at least one week, and at least one month.

Accordingly, the organoalkoxysilanes disclosed herein may be used as coupling agents and primers. The silane effectiveness with respect to binding to a surface depends upon, for example, the surface used. In order of increasing effectiveness from poor to excellent, the following substances may, for example, be used as surfaces in the embodiments disclosed herein: carbon black; graphite; barytes; gypsum; chalk; lead; zinc; nickel; asbestos; steel/iron; inorganic oxides, such as $Fe_2O_3$, $TiO_2$, and $Cr_2O_3$; talc; mica; alumino-silicates; copper; aluminum; glass; quartz; and silica. As one of ordinary skill in the art would recognize, this includes surfaces such as ceramics, tiles, windows, appliances, sinks, natural stones, cements, windshields, automobile parts, outdoor furniture, and toilet bowls.

The cleaning compositions disclosed herein may be distinguished from other similar products due to the cleaning composition's synergistic effect of the at least one hydrophobic water-dispersible polymer and the at least one hydrophilic polymer, and its long-lasting effects. While not wishing to be bound by theory, it is thought that synergy may result because instead of absorbing at the hydrophobic interface, hydrophobic polymer beads are content to aggregate into a central region between the hydrophilic groups and the interface, similar to a self-assembled bilayer, and affecting the deposition mechanism as well as the long-lasting duration of the effect.

The cleaning compositions disclosed herein also enhance or create an auto-cleaning effect on the surface because, after the surface has been treated with the cleaning composition to yield a hydrophobic film on the surface, larger drops of water or liquid are able to slide across the hydrophobic surface and may act to remove the smaller drops of water or liquid that are not heavy enough to slide away by the effect of gravity and/or wind alone.

In certain embodiments, the cleaning compositions disclosed herein comprise at least one hydrophobic water-dispersible polymer. As used herein, water-dispersible indicates that the polymer may be insoluble but breakable in water by being dispersible, i.e., the polymer breaks down into small fragments, for example as a result of the application of mechanical or shear force. In certain embodiments, the at least one hydrophobic, water-dispersible polymer is chosen from polyacrylates, carboxyvinyl copolymers, methyl methacrylate copolymers and polyacrylic acid. In some embodiments, the at least one hydrophobic water-dispersible polymer comprises organoalkoxysilane. In certain embodiments, the at least one hydrophobic water-dispersible polymer comprising organoalkoxysilane may, for example, be at least one of Momentive® Y-17713 and Momentive® Y-20189 available from Momentive Progressive Materials.

According to various embodiments of the disclosure, the organoalkoxysilane may have the formula $Y—R^1—Si(OR)_3$, wherein Y is an organic reactive group such as epoxide, methacrylate, —SH, amine, isocyanate, vinyl, and the like; $R^1$ is an organic non-reactive group; and R is a hydrolysable group, such as methyl, ethyl, and isopropyl. It is noted that the organoalkoxysilanes disclosed herein are not siloxanes. Siloxanes differ from silanes in that siloxanes generally do not react chemically when acting, for example, as an antifoam, demulsifer, or foamant, in part due to the stability of the Si-methyl (i.e., Si—C) bond. Silanes, however, react, as the Si—O—C bond hydrolyzes with water. Accordingly, silanes can bond to solid surfaces, cross-link, and bind inorganic and organic materials. While not wishing to be bound by theory, it is believed that the organoalkoxysilanes disclosed herein may prime the surface being treated by reacting via hydrolyzation in the presence of water, such that an —OR group binds to the surface, such as glass, to which the cleaning composition is applied. The surface primed with the organoalkoxysilane may then react via the organic reactive —Y group then to couple the surface with a hydrophobic polymer film. The hydrophobic polymer film that is coupled to the surface via the organoalkoxysilane provides the surface with long-lasting protection, for example protection from rain, dirt, and lime scale buildup.

The at least one hydrophobic water-dispersible polymer may be present in the cleaning composition in any effective amount. For example, in certain embodiments the at least one hydrophobic water-dispersible polymer is present in the cleaning composition in an amount ranging from about 0.1% to about 3%, such as about 0.2% to about 1%, about 0.25% to about 0.75%, or about 0.25%, about 0.5%, or about 0.75%, by weight based on the total weight of the cleaning composition.

The cleaning compositions disclosed herein further comprise at least one hydrophilic polymer. In various embodiments, the hydrophilic polymer may adsorb to hard surfaces, i.e., an anti-adhesion polymer. As used herein, the term "anti-adhesion polymer" refers to a polymer that prevents the adhesion of soils to a hard surface, either by creating a physical barrier impeding soils from sticking to the surface or allowing a better flowing of the soil from the surface. In certain embodiments, the anti-adhesion polymer is a hydrophilic polymer. In certain embodiments disclosed herein, the cleaning composition comprises an anti-adhesion polymer, an one acid, and a surfactant system. In additional embodiments, the cleaning composition may further comprise water.

In certain embodiments, the anti-adhesion polymer may comprise a polybetaine. For example, useful polymers that may be included in the compositions as disclosed herein are those polymers available under the tradename Mirapol® Surf S-500 or Mirapol® Surf-S 110 from Rhodia, Inc. (Tennessee, USA), and may be further described in U.S. Patent Application Publication No. 2006/0217286 to Geoffrey et al. Other useful polymers include, for example, a polymeric quaternary ammonium salt consisting of acrylamide and dimethyl dialkyl ammonium chloride monomers, also known as Polyquaternium-7 and available, for example, under the tradename Merquat® 550 from Nalco Company (Illinois, USA); or water-soluble polymers such as those available under the trade name Sokalan® from BASF Company (New Jersey, USA). These may include, for example, Sokalan® HP 70, or polycarboxylates such as maleic acid/olefin copolymers such as those available under the trade name Sokalan® CP 9 from BASF or Acusol® 460 NK available from Rohm & Haas (Pennsylvania, USA). In various embodiments of the disclosure, the at least one hydrophilic polymer is an organomodified polymer, such as a silylated/organic surfactant blend such as Silwet® HS-212 from Momentive Performance Materials.

The at least one hydrophilic polymer may be present in the cleaning composition in any effective amount. For example, in certain embodiments the at least one hydrophilic polymer is present in the cleaning composition in an amount ranging from about 0.01% to about 3%, such as about 0.05% to about 1%, about 0.1% to about 0.5%, or about 0.1%, about 0.2%, or about 0.5%, by weight based on the total weight of the cleaning composition. In certain embodiments, the at least one hydrophilic polymer is present in an amount of less than about 3% or less than about 1%, by weight relative to the total weight of the cleaning composition. While not wishing to be bound by theory, it is believed that higher amounts of the at least one hydrophilic polymer increases the hydrophilicity of the surface and may leave residue on the surface.

In certain embodiments disclosed herein, the at least one hydrophobic water-dispersible polymer and the at least one hydrophilic polymer are present in the cleaning composition in a synergistic amount. As used herein, the term synergistic means that effect of the polymers together in a composition is greater than the sum total of the effect of each polymer separately in a composition. In certain embodiments, the at least one hydrophobic water-dispersible polymer may act synergistically together with the at least one hydrophilic polymer to enhance water-repellency of the substrate, provide shine, and/or deter buildup. The synergistic effect or effects may be long-lasting. In certain embodiments, the synergistic effects may last at least one day, at least two days, at least three days, at least one week, or at least one month. In certain embodiments, synergism is found then the cleaning composition comprises, for example, at least one hydrophobic water-dispersible polymer in an amount ranging from about 0.25% to about 0.75%, such as about 0.5%, by weight based on the total weight of the cleaning composition; and at least one hydrophilic polymer in an amount ranging from about 0.1% to about 0.5%, such as about 0.2%, by weight based on the total weight of the cleaning composition.

In certain embodiments of the disclosure, the at least one hydrophobic water-dispersible polymer is an organoalkoxysilane having the formula $Y—R^1—Si(OR)_3$, wherein Y is an organic reactive group such as epoxide, methacrylate, —SH, amine, isocyanate, vinyl, and the like; $R^1$ is an organic non-reactive group; and R is a hydrolysable group, such as methyl, ethyl, and isopropyl; and the at least one hydrophilic polymer is an organomodified copolymer such as Silwet® HS-212. In certain embodiments, the at least one hydrophobic polymer is an organoalkoxysilane having the formula $Y—R^1—Si(OR)_3$, wherein Y is an organic reactive group such as epoxide, methacrylate, —SH, amine, isocyanate, vinyl, and the like; $R^1$ is an organic non-reactive group; and R is a hydrolysable group, such as methyl, ethyl, and isopropyl, and is present in the cleaning composition in an amount ranging from about 0.25% to about 0.75%, such as about 0.5%, by weight based on the total weight of the cleaning composition; and the at least one hydrophilic polymer is an organomodified copolymer such as Silwet® HS-212 and is present in the cleaning composition in an amount ranging from about 0.1% to about 0.5%, such as about 0.2%, by weight based on the total weight of the cleaning composition.

The cleaning compositions disclosed herein may further comprise a surfactant system. A surfactant system may comprise one surfactant or a combination of two or more surfactants. In certain embodiments, the surfactant may be chosen from non-ionic surfactants, zwitterionic surfactants, and anionic surfactants. Exemplary zwitterionic surfactants may, for example, include cocoamidopropyl betaine, lauryl/myristyl dimethyl betaine, and cocoamidopropyl hydroxyl betaine. Non-ionic surfactants (such as alkoxylated alcohol non-ionic surfactants, e.g., polyethoxylated alcohol, or alkyl polyglucoside) may be useful for certain embodiments. The cleaning compositions disclosed herein may comprise a surfactant or a surfactant system in an amount ranging from about 0.1% to about 15%, from about 0.1% to about 12%, from about 0.1% to about 10%, from about 0.1% to about 8%, from about 0.1% to about 6%, from about 0.5% to about 15%, from about 0.5% to about 12%, from about 0.5% to about 10%, from about 0.5% to about 8%, from about 0.5% to about 6%, from about 1% to about 15%, from about 1% to about 12%, from about 1% to about 10%, from about 1% to about 8%, from about 1% to about 6%, or from about 3% to about 6%, by weight based on the total weight of the cleaning composition. The cleaning composition may, for example, comprise at least one zwitterionic surfactant such as cocoamidopropyl betaine, in an amount ranging from about 3% to about 4%.

In certain embodiments, the cleaning composition comprises at least one acid. Examples of acids include, but are not limited to, an organic acid, an inorganic acid, lactic acid, formic acid, citric acid, sorbic acid, acetic acid, glycolic acid, propanoic acid, propionic acid, oxalic acid, maleic acid, tartaric acid, adipic acid, malic acid, malonic acid, glycolic acid, and combinations thereof. According to one exemplary embodiment, the at least one acid is lactic acid. The lactic acid may be present in any effective amount, including an amount effective to reduce the pH of the composition to a desirable amount, such as a pH ranging from about 1 to about 6, such as about 3 to about 4. In certain embodiments, the at least one acid may be present in the composition in an amount ranging from about 1% to about 10%, such as about 2% to about 5%, about 3% to about 4%, or about 3%, by weight relative to the total weight of the composition.

The cleaning compositions disclosed herein may further comprise at least one solvent, such as at least one solvent in addition to water. Exemplary solvents may include, but are not limited to, at least one of alkylene glycols, glycol ethers, propylene glycol n-butyl ether, propylene glycol n-propyl ether, ethylene glycol n-hexal ether, ethylene glycol n-butyl ether, dipropylene glycol methyl ether, $C_1$ to $C_6$ alkyl alcohols including methyl alcohol and ethyl alcohol, n-propanol, isopropanol, n-butyl alcohol, sec-butyl alcohol, isobutyl alcohol, tert-butyl alcohol, 1-, 2-, or 3-pentanol, neopentyl alcohol, and hexanol. In certain embodiments, the at least one solvent includes both propylene glycol n-butyl ether and ethyl alcohol. The at least one solvent may be present in the cleaning composition in an amount ranging from about 0.1% to about 10%, such as about 0.5% to about 5%, 1% to about 3%, about 1.5%, or about 3%, by weight based on the total weight of the cleaning composition.

The cleaning composition may optionally contain any other additives that are used in cleaning compositions, such as colorants, fragrances, pro-fragrances, preservatives, rheology modifiers, structuring agents, hydrotropes, whitening agents, reducing agents, enzymes, enzyme stabilizing agents, builders, bleaches, photobleaches, bleach catalysts, soil release agents, dye transfer inhibitors, buffers, soil repellents, water-resistance agents, suspending agents, aesthetic agents, and combinations thereof. These materials can be used in any desired amount.

As used herein, the term "fragrance" is used in its ordinary sense to refer to and include any perfumes, such as non-water soluble fragrant substances or mixtures of substances including natural (i.e., obtained by extraction of flower, herb, blossom or plant), artificial (i.e., mixture of natural oils or oil constituents) and synthetically produced substance) odoriferous substances. Fragrances may include complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the fragrance.

In the cleaning compositions disclosed herein, the precise composition of the fragrance is of no particular consequence to cleaning performance so long as it meets the criteria of having a pleasing odor. Naturally, of course, especially for cleaning compositions intended for use in the home, the fragrance, as well as all other ingredients, may be cosmetically acceptable, i.e., non-toxic, hypoallergenic, etc.

The cleaning composition may be formulated to any pH. In certain embodiments, the pH is acidic, such that the cleaning composition has a pH ranging from about 1 to about 6, such as about 3 to about 4.

The cleaning composition may be supplied as a ready-to-use composition. Alternatively, in certain embodiments, the cleaning composition may be supplied as a concentrate that may later be diluted with water. The composition can be at least 2, at least 3, at least 4, or at least 5 times concentrated from the above ready-to-use composition, in which case, the amounts of materials included in the composition are adjusted accordingly.

In various embodiments, the cleaning compositions disclosed herein are aqueous compositions and comprise at least about 50% water, by weight based on the total weight of the cleaning composition. In certain embodiments, the cleaning compositions disclosed herein comprise at least about 75%, at least about 80%, at least about 85%, or at least about 90% water, by weight based on the total weight of the cleaning composition.

Additionally, the cleaning composition disclosed herein may be in the form of a liquid spray. It has been observed that, in certain embodiments of a liquid spray, the spray may foam, caused by the combination of a spray mechanism coupled with a mesh piece, and the foam may exhibit good performance in the polymer deposition on the surface and also saves the user the wiping process, as it only needs to be rinsed away.

Further disclosed herein are methods for cleaning a surface, such as a glass surface, comprising applying to the surface a cleaning composition comprising at least one hydrophobic water-dispersible polymer comprising organoalkoxysilanes and at least one hydrophilic polymer to the surface; and allowing the cleaning composition to dry on the surface.

In certain embodiments, the methods disclosed herein serve to clean the surface of soil (such as dirt and dust), lime scale, soap scum, and/or other residue buildup. In various embodiments of the methods disclosed herein, the water-repellency of the surface is enhanced after allowing the cleaning composition to dry on the surface. Furthermore, in certain embodiments of the methods disclosed herein, the shine and ability of the surface to deter dirt, lime scale, soap build-up, and/or other residue buildup is enhanced after allowing the cleaning composition to dry on the surface. The methods disclosed herein may allow for the water-repellency, shine, and/or ability of the surface to deter build-up to last for a long time, such as, for example, at least about one day, at least about two days, at least about three day, at least about one week, or at least about one month.

In certain embodiments, the longevity of the cleaning composition's benefits on a surface may be characterized using a Mobile Surface Analyzer (MSA) to obtain contact angle and surface free energy measurements. For example, the water-repellency of a surface, such as a glass surface, may be evaluated by the contact angle and surface free energy measurements for that surface when a drop of a liquid, such as a reference solvent and/or water, is applied to the surface. A high contact angle and/or a high surface free energy indicate enhanced water-repellency in a surface.

As used herein, contact angle refers to a measurement through a liquid, such as water, where the liquid-vapor interface meets a solid, such as a glass surface. A high contact angle for water on a surface indicates a high degree of water-repellency for the surface. In certain embodiments, the contact angle for water after the composition disclosed herein has been applied to a surface and allowed to dry may, for example, range from about 35° to about 80°, such as from about 55° to 78°. In certain embodiments, the contact angle may be at least about 50°, such as at least about 60°, at least about 70°, or at least about 100°. In certain embodiments, the contact angle may range from about 50° to about 150°, such as ranging from about 60° to about 140°, ranging from about 70° to about 130°, ranging from about 100° to about 150°, or ranging from about 110° to about 130°. In certain embodiments, the contact angle may at least about 50°, such as ranging from about 100° to about 150°, after the composition disclosed herein has been applied to a surface and allowed to dry, and the surface rinsed with water, such as rinsed with water at least one time, at least two times, at least three times, at least four times, at least five times, at least six times, or at least seven times.

As used herein, surface free energy refers to the amount of work expended to increase the size of a surface of a substance, and may be measured in terms of energy per unit area, or $mJ/m^2$ or mN/m. In certain embodiments, surface free energy may be measured indirectly via the measurement of the contact angle of various liquids. In certain embodiments, the surface free energy of a surface after the cleaning composition disclosed herein has been applied to the surface and allowed to dry may, for example, range from about 35 mN/m to about 62 mN/m, such as from about 40 mN/m to about 57 mN/m.

According to certain embodiments disclosed herein, the at least one hydrophobic water-dispersible polymer comprising organoalkoxysilanes and the at least one hydrophilic polymer act synergistically in the cleaning composition to increase the contact angle of water on a surface treated with the cleaning composition and/or to increase the surface free energy of the surface.

In certain embodiments disclosed herein, the contact angle and surface free energy may be measured using a New Kruss MSA. The MSA may measure surface free energy on a surface based on Owens-Wendt-Rabel-Kaeble, Wu, Zisman, Fowkes, and Oss and Good models, comparing the contacts of a drops of two liquids, a reference solvent and water. Accordingly, further disclosed herein is a method of measuring the contact angle on a surface comprising contacting the surface with at least one drop of a liquid, such as water, and measuring the contact angle of the drop. Also disclosed herein is a method of measuring the surface free energy of a surface comprising contacting the surface with at least one drop of a liquid, such as water, and measuring the surface free energy of the surface.

Readings may be automatic, and the MSA equipment may be mobile. The MSA releases two parallel drops onto a surface with one click, followed by the direct analysis of the contact angles for each drop and the derived results of the surface free energy. In certain embodiments, of the steps performed are automated and may occur with a second. The results may provide information regarding the wettability of aqueous and/or organic liquids.

The MSA methodology disclosed herein may allow for the quantification of surface energy and hydrophilicity through contact angle measurement. In certain exemplary embodiments, the MSA methodology may be applied to both porous and non-porous surfaces, such as cement, stone, tile, ceramic, and glass.

In certain embodiments of the disclosure, the MSA methodology may comprise applying the composition to be tested to a surface; leaving the composition on the surface for a period of time, such as, for example, less than 10 minutes; rinsing the surface with water; and conducting contact angle and surface free energy measurements after rinsing. By repeating cycles of rinsing and measuring, the longevity and/or efficacy of the composition may be ascertained.

The compositions of the present invention may be dispensed by any means known in the art of cleaning compositions. For example, in certain embodiments, the compositions may be dispensed by a spray bottle to the area to be cleaned. Optionally, the pump on the spray bottle may have a foaming mechanism so that the formulation is dispensed in the form of a foam. Accordingly, in various embodiments, the invention further provides a non-aerosol container containing the cleaning composition and having a spray pump so that the composition can be sprayed on the surface to be cleaned, e.g., wherein the spray pump is a foam-generating pump so that the formulation can be dispensed in the form of a foam.

EXAMPLES

Example 1

Twenty-four prototype compositions were prepared as shown below in Tables 1 and 2, wherein the prototype compositions comprised varying amounts of at least one hydrophobic water-dispersible polymer and at least one hydrophilic polymer.

TABLE 1

| Cleaning Composition Prototypes | | | | | | | | | | | | |
|---|---|---|---|---|---|---|---|---|---|---|---|---|
| Ingredient | #1 (%) | #2 (%) | #3 (%) | #4 (%) | #5 (%) | #6 (%) | #7 (%) | #8 (%) | #9 (%) | #10 (%) | #11 (%) | #12 (%) |
| Cocoamidopropyl betaine, high pH | 3.61 | 3.61 | 3.61 | 3.61 | 3.61 | 3.61 | 3.61 | 3.61 | 3.61 | 3.61 | 3.61 | 3.61 |
| 96% Ethyl alcohol, denatured | 1.5 | 1.5 | 1.5 | 1.5 | 1.5 | 1.5 | 1.5 | 1.5 | 1.5 | 1.5 | 1.5 | 1.5 |
| Propylene glycol N-butyl ether | 1.5 | 1.5 | 1.5 | 1.5 | 1.5 | 1.5 | 1.5 | 1.5 | 1.5 | 1.5 | 1.5 | 1.5 |
| Hydrophobic polymer comprising organoalkoxysilane | 0.25 | 0.5 | 0.75 | 0.25 | 0.25 | 0.25 | 0.5 | 0.5 | 0.5 | 0.75 | 0.75 | 0.75 |
| Hydrophilic polymer | — | — | — | 0.1 | 0.2 | 0.5 | 0.1 | 0.2 | 0.5 | 0.1 | 0.2 | 0.5 |
| Lactic acid, food grade (80%) | 3.09 | 3.09 | 3.09 | 3.09 | 3.09 | 3.09 | 3.09 | 3.09 | 3.09 | 3.09 | 3.09 | 3.09 |
| Water | QS | QS | QS | QS | QS | QS | QS | QS | QS | QS | QS | QS |

TABLE 2

| Cleaning Composition Prototypes | | | | | | | | | | | | |
|---|---|---|---|---|---|---|---|---|---|---|---|---|
| Ingredient | #13 (%) | #14 (%) | #15 (%) | #16 (%) | #17 (%) | #18 (%) | #19 (%) | #20 (%) | #21 (%) | #22 (%) | #23 (%) | #24 (%) |
| Cocoamidopropyl betaine, high pH | 3.61 | 3.61 | 3.61 | 3.61 | 3.61 | 3.61 | 3.61 | 3.61 | 3.61 | 3.61 | 3.61 | 3.61 |
| 96% Ethyl alcohol, denatured | 1.5 | 1.5 | 1.5 | 1.5 | 1.5 | 1.5 | 1.5 | 1.5 | 1.5 | 1.5 | 1.5 | 1.5 |
| Propylene glycol N-butyl ether | 1.5 | 1.5 | 1.5 | 1.5 | 1.5 | 1.5 | 1.5 | 1.5 | 1.5 | 1.5 | 1.5 | 1.5 |
| Hydrophobic polymer comprising organoalkoxysilane | 0.25 | 0.5 | 0.75 | 0.25 | 0.25 | 0.25 | 0.5 | 0.5 | 0.5 | 0.75 | 0.75 | 0.75 |
| Hydrophilic polymer | — | — | — | 0.1 | 0.2 | 0.5 | 0.1 | 0.2 | 0.5 | 0.1 | 0.2 | 0.5 |
| Lactic acid, food grade (80%) | 3.09 | 3.09 | 3.09 | 3.09 | 3.09 | 3.09 | 3.09 | 3.09 | 3.09 | 3.09 | 3.09 | 3.09 |
| Water | QS | QS | QS | QS | QS | QS | QS | QS | QS | QS | QS | QS |

The MSA contact angle and surface free energy measurements were obtained using a Kruss MSA after a drop of water was applied to a glass surface. The glass surfaces were then treated with the prototype compositions, and the compositions were allowed to dry on the glass surface, but were not wiped off. The contact angles and surface free energies were then measured on the surface after application of each prototype composition, using a Kruss MSA, as described above. The results for the contact angle measurements are shown below in Table 3. As shown, the contact angle increased after treatment for each prototype composition tested, which indicates increased water repellency.

TABLE 3

| MSA Contact Angle Measurements of Compositions | | |
|---|---|---|
| Composition # | Contact Angle before Treatment | Contact Angle after Treatment |
| 1 | 15.05 | 56.69 |
| 2 | 16.10 | 63.70 |
| 3 | 15.25 | 69.58 |
| 4 | 24.80 | 59.95 |
| 5 | 27.66 | 65.08 |
| 6 | 14.91 | 69.64 |
| 7 | 16.07 | 60.22 |
| 8 | 22.86 | 78.73 |
| 9 | 25.36 | 66.59 |

TABLE 3-continued

| MSA Contact Angle Measurements of Compositions | | |
|---|---|---|
| Composition # | Contact Angle before Treatment | Contact Angle after Treatment |
| 10 | 31.79 | 65.50 |
| 11 | 47.48 | 58.27 |
| 12 | 17.60 | 68.13 |
| 13 | 16.59 | 70.06 |
| 14 | 26.32 | 41.19 |
| 15 | 23.44 | 78.02 |
| 16 | 18.85 | 71.30 |
| 17 | 23.05 | 65.79 |
| 18 | 28.15 | 69.11 |
| 19 | 19.22 | 56.43 |
| 70 | 14.69 | 56.88 |
| 21 | 20.80 | 57.50 |
| 77 | 17.73 | 64.61 |
| 23 | 16.16 | 35.13 |
| 24 | 32.66 | 55.15 |

The surface free energy of the 24 compositions prepared was also measured. The results are shown below in Table 4. As shown, the surface free energy of the surface decreased after treatment for each prototype composition tested, which indicates increased water repellency.

TABLE 4

| Surface Free Energy Measurements of Compositions | | |
|---|---|---|
| Composition # | Surface Free Energy (OWRK) (mN/m) before treatment | Surface Free Energy (OWRK) (mN/m) after treatment |
| 1 | 73.87 | 47.54 |
| 2 | 73.17 | 43.02 |
| 3 | 73.92 | 39.83 |
| 4 | 70.9 | 45.93 |
| 5 | 69.50 | 44.27 |
| 6 | 73.88 | 40.24 |
| 7 | 73.57 | 47.27 |
| 8 | 71.12 | 35.25 |
| 9 | 70.26 | 41.50 |
| 10 | 67.60 | 43.00 |
| 11 | 57.23 | 49.11 |
| 12 | 72.50 | 39.84 |
| 13 | 73.49 | 39.49 |
| 14 | 69.80 | 57.44 |
| 15 | 74.73 | 41.98 |
| 16 | 72.34 | 39.54 |
| 17 | 70.44 | 41.96 |
| 18 | 67.84 | 39.66 |
| 19 | 76.62 | 49.53 |
| 70 | 72.30 | 46.51 |
| 21 | 70.34 | 48.92 |
| 22 | 71.04 | 42.52 |
| 23 | 73.82 | 61.33 |
| 24 | 66.95 | 49.18 |

The results demonstrate the water-repellency and protective shield effect. Keeping a concentration ranging from about 0.5% to about 0.75% of the hydrophobic polymer plus 0.5% hydrophilic polymer showed significant improvement in water repellency.

While the disclosure has been described with respect to specific examples including presently preferred modes of carrying out the disclosure, those skilled in the at will appreciate that there are numerous variations and permutations of the above described systems and techniques. Itis to be understood that other embodiments may be utilized and structural and functional modifications may be made without departing from the scope of the present disclosure. Thus, the scope of the disclosure should be construed broadly as set forth in the appended claims.

The invention claimed is:

1. A cleaning composition comprising:

a polymer system comprising:

a hydrophobic polymer comprising an organoalkoxysilane;

a hydrophilic polymer present in the cleaning composition in an amount ranging from about 0.1% to about 0.5% by weight based on the total weight of the cleaning composition;

a surfactant system; and an acid;

wherein the organoalkoxysilane has a formula $Y—R^1—Si(OR)_3$, in which Y is an organic reactive group chosen from epoxide, methacrylate, —SH, isocyanate, and vinyl; $R^1$ is an organic non-reactive group; and R is a hydrolysable group.

2. The cleaning composition according to claim 1, wherein the surfactant system comprises a zwitterionic surfactant.

3. The cleaning composition according to claim 2, wherein the zwitterionic surfactant is cocoamidopropyl betaine.

4. The cleaning composition according to claim 1, wherein the acid is an organic acid selected from the group consisting of lactic acid, formic acid, citric acid, sorbic acid, acetic acid, propanoic acid, propionic acid, oxalic acid, maleic acid, tartaric acid, adipic acid, malic acid, malonic acid, glycolic acid; and a combination of two or more thereof.

5. The cleaning composition according to claim 1, wherein the acid is an organic acid.

6. The cleaning composition according to claim 1, wherein the acid is lactic acid.

7. The cleaning composition according to claim 1, wherein the hydrolysable group R is selected from methyl, ethyl, and isopropyl.

8. The cleaning composition according to claim 1, wherein the hydrophobic polymer is present in an amount ranging from about 0.25% to about 0.75% by weight based on the total weight of the cleaning composition.

9. The cleaning composition according to claim 1, wherein the hydrophobic polymer is present in an amount ranging from about 0.5% to about 0.75%, by weight based on the total weight of the cleaning composition.

10. The cleaning composition according to claim 1, wherein the hydrophilic polymer is an organomodified copolymer.

11. The cleaning composition according to claim 1, wherein the hydrophilic polymer is present in the cleaning composition in an amount of about 0.5% by weight based on the total weight of the cleaning composition.

12. The cleaning composition according to claim 1, wherein the surfactant system comprises from about 1% to about 3%, by weight, of the cleaning composition.

13. The cleaning composition according to claim 1, wherein the acid is an organic acid comprising from about 1% to about 3%, by weight, of the cleaning composition.

14. The cleaning composition according to claim 1, further comprising a solvent.

15. The cleaning composition according to claim 14, wherein the solvent comprises propylene glycol n-butyl ether.

16. The cleaning composition according to claim 14, wherein the solvent comprises ethyl alcohol.

17. The cleaning composition according to claim 14, wherein the solvent comprises from about 1% to about 3%, by weight, of the cleaning composition.

18. The cleaning composition according to claim 1, further comprising an additional ingredient selected from the group consisting of a colorant, a fragrance, a pro-fragrance, a preservative, a rheology modifier, a structuring agent, a hydrotrope, a whitening agent, a reducing agent, an enzyme, an enzyme stabilizing agent, a builder, a bleach, a photobleach, a bleach catalyst, a soil release agent, a dye transfer inhibitor, a buffer, a soil repellent, a water-resistance agent, a suspending agent, an aesthetic agent; and a combination of two or more thereof.

19. The cleaning composition according to claim 1, wherein the hydrophobic polymer is water-dispersible.

20. A method of cleaning a surface, comprising:

applying a cleaning composition comprising:

a polymer system comprising a hydrophobic polymer comprising an organoalkoxysilane; and from about 0.1% to about 0.5%, by weight, of a hydrophilic polymer;

a surfactant system; and an organic acid, to a surface; and retaining the cleaning composition on the surface until it dries;

wherein the organoalkoxysilane has a formula $Y—R^1—Si(OR)_3$, in which Y is an organic reactive group chosen from epoxide, methacrylate, —SH, isocyanate, and vinyl; $R^1$ is an organic non-reactive group; and R is a hydrolysable group.

* * * * *